United States Patent [19]

Pfarrwaller et al.

[11] 3,982,567

[45] Sept. 28, 1976

[54] SHUTTLE RETURN APPARATUS

[75] Inventors: Erwin Pfarrwaller, Winterthur; Kurt Nick, Ettenhausen, both of Switzerland

[73] Assignee: Sulzer Brothers Limited, Winterthur, Switzerland

[22] Filed: Mar. 14, 1975

[21] Appl. No.: 558,290

Related U.S. Application Data

[63] Continuation of Ser. No. 395,564, Sept. 10, 1973, abandoned.

[30] Foreign Application Priority Data

Sept. 8, 1972 Switzerland ..... 13196/72

[52] U.S. Cl. ..... 139/439

[51] Int. Cl.[2] ..... D03D 47/24

[58] Field of Search..... 139/12, 125, 126, 436–439; 193/25, 40; 198/168–174

[56] References Cited

UNITED STATES PATENTS

| | | | |
|---|---|---|---|
| 3,263,705 | 8/1966 | Rossmann | 139/12 |
| 3,674,160 | 7/1972 | Gutowski | 198/173 X |
| 3,765,458 | 10/1973 | Ziegler et al. | 139/126 |
| 3,817,291 | 6/1974 | Welzel | 139/125 |
| 3,880,197 | 4/1975 | Bucil et al. | 139/12 |
| 3,881,524 | 5/1975 | Bracher et al. | 139/126 |

FOREIGN PATENTS OR APPLICATIONS

| | | | |
|---|---|---|---|
| 1,098,802 | 1/1968 | United Kingdom | 139/125 |

*Primary Examiner*—James Kee Chi
*Attorney, Agent, or Firm*—Pennie & Edmonds

[57] ABSTRACT

For the return of shuttles from the catching to picking side of a loom of gripper shuttle type, a housing encloses an endless belt and reaches from the catching to the picking side of the loom. Within the housing there is provided a separate guide rail for the shuttles, extending along one run of the belt. The rail is made of elastic material and includes one or more flanges for frictional engagement with the shuttles as propelled along the rail by carrying elements affixed to the belt.

6 Claims, 3 Drawing Figures

SHUTTLE RETURN APPARATUS

This is a continuation of application Ser. No. 395,564, filed Sept. 10, 1973, now abandoned.

The present invention relates to apparatus for the return of the weft insertion elements of a loom from the catching to the picking side thereof for the insertion of additional weft threads, as in looms employing gripper shuttles. Such apparatus includes means defining a guide path along which the shuttles move from the catching to the picking side.

In one previously known form of apparatus of this general character the guide path is defined by part of a steel housing for the entire shuttle return apparatus, including the endless belt or chain by which the shuttles are propelled along the guide path. Especially in the case of looms for the weaving of wide cloth, for example from 4 to 5 meters wide, this housing must have a large cross-section in order to possess the necessary stiffness.

At the catching side of the loom where the gripper shuttles or other weft insertion devices fall onto or into the guide path, the path (e.g. a channel or chute) is subjected to impacts and abrasion which are injurious to the shuttles as well as the return mechanism, and this undesired wear occurs along the length of the guide path as well. The guide path must therefore be replaced relatively frequently, with undesired interruption in operation of the loom.

It is an object of the invention to provide shuttle return mechanism improved in this respect. In accordance with the invention, the return mechanism includes a chute or rail made of an elastic material, for example a synthetic one.

In the shuttle return apparatus of the invention, the blows which occur upon impact of the shuttles on the chute are dampened. The shuttles and the chute are spared undesired wear both at this point and over the entire return path of the shuttles. When however replacement of the chute is necessary, it can be readily effected.

BRIEF DESCRIPTION OF THE DRAWINGS

The invention will now be further described in terms of a number of presently preferred exemplary embodiments and with reference to the accompanying drawings in which.

DESCRIPTION OF THE PREFERRED EMBODIMENTS

Figure 1:
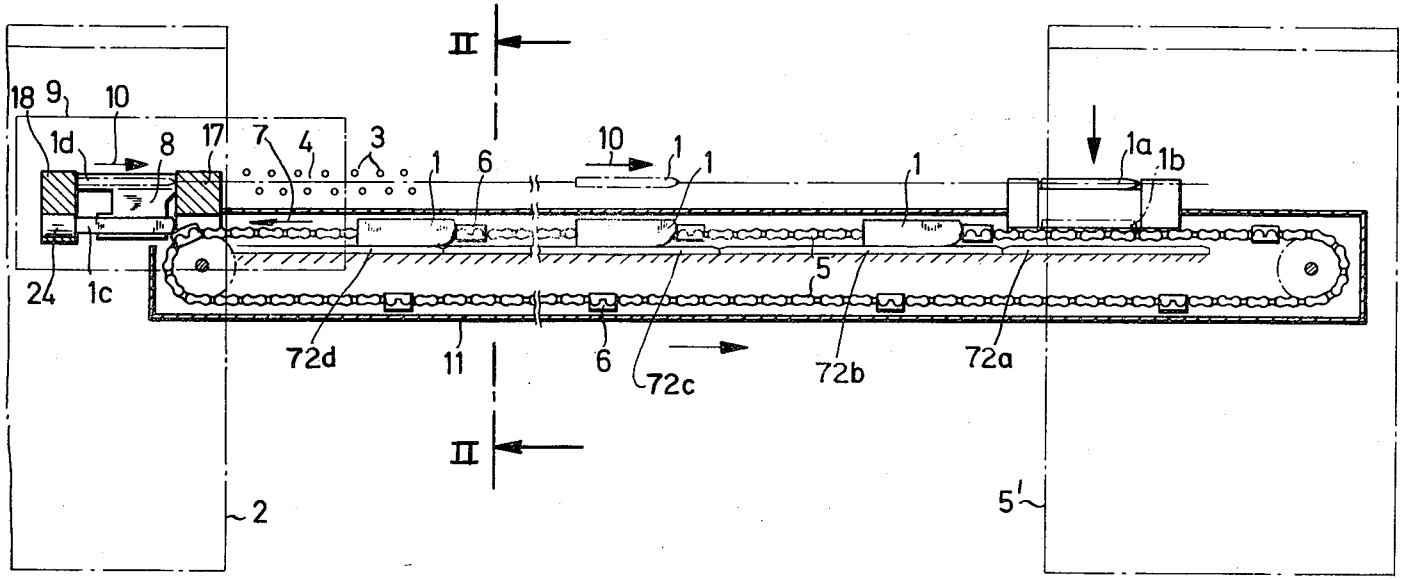
FIG. 1 is a diagrammatic representation of one embodiment of the invention, shown together with those portions of a loom useful for a description of the invention.

In the gripper shuttle loom of FIG. 1 the shuttles 1 pass from the picking mechanism 2 along the path identified by the arrow 10 through the shed 4 formed by warp threads 3 and are brought to rest at the position 1*a* in a catcher mechanism 5'. From the catcher mechanism they are delivered, by a mechanism not shown, to the position 1*b* from which they pass over the return mechanism to the picking side again, where they are delivered by the chain 5 to the position 1*c*. This return mechanism includes an endless chain or belt 5 to which are fastened carrier elements 6. They may be approximately of the type shown in the copending application of George Ziegler et al., Ser. No. 233,262, filed Mar. 9, 1972, which is assigned to the assignee hereof. The shuttles are carried or propelled by means of the carriers 6 along the path identified by arrow 7 back to position 1*c* in the picking mechanism 2. From there they are lifted by lifting mechanism 8 to the departure position 1*d* where they are ready for renewed picks through the shed. Along the return path 7 the shuttles are subjected to a retarding or decelerating effect, advantageously in the range of positions 9 but optionally over the whole path length. By this means the result may be obtained that over the whole path or at least over the path portion 9 the shuttles are free from oscillations or irregularity in their motion.

Figure 2:
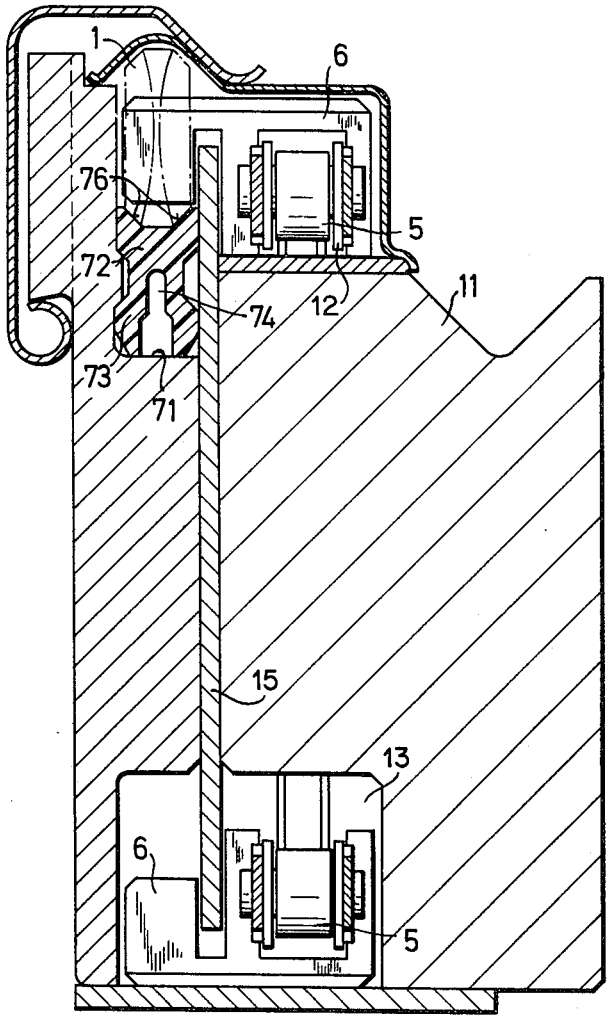
FIG. 2 is a sectional view taken on lines II—II of FIG. 1, shown however at an enlarged scale.

The chain 5 moves within a casing or housing 11, in which are formed channels 12 and 13 for the upper and lower runs of the chain. A plate 15 divides each of these channels into two parts, one for the links of the chain proper and the other (to the left, in FIG. 2) for that portion of the carriers 6 which engages the shuttles. The upper channel is deepened into a slot or groove at 71 to accommodate a rail 72 on which the shuttles slide in their return motion from the catching to the picking side of the loom. This rail defines a guide path for the shuttles. The rail may be made of a synthetic material such as an acetal resin, for example that known under the trademark Delrin. The rail is held in the groove 71 by spring pressure exerted against the left wall of the groove and the plate 15 by the resilience of the rail, which is split at its lower portion into two limbs 73 separated by a slot 74. The rail 72 provides a path 76 adapted to the shape of gripper shuttles 1 and over which they slide in a uniform motion. The rail 72 is made up of several sections 72*a*, 72*b*, 72*c* and 72*d* (FIG. 1) which extend over the entire width of the loom, from the interior of the catching mechanism 5' to the interior of the picking mechanism 2. This has the advantage that the rail may be replaced in sections instead of requiring replacement of the whole rail when one portion only thereof has become worn.

Figure 3:
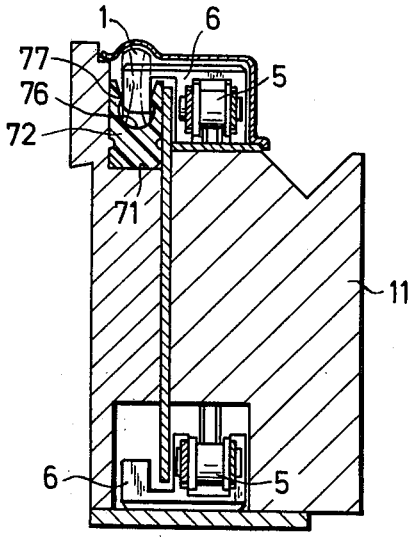
FIG. 3 is a similar section, illustrating a modified construction in accordance with the invention, shown however at a reduced scale.

In the embodiment of FIG. 3 the rail 72 includes braking strips or flanges 77 which are disposed on both sides of the shuttle path to engage the same frictionally and which also serve to reinforce the positioning of the rail. By the braking action of the strips 77 the shuttles are prevented from oscillating or irregular motion and from blows against the chain 5 and the carrier element 6 so as to move with the carrier elements back to the picking side of the loom.

While the invention has been hereinabove described in terms of a number of presently preferred embodiments thereof, it is not limited thereto. Rather, the invention comprehends all modifications on and departures from those embodiments properly falling within the spirit and scope of the appended claims.

We claim:

1. A gripper shuttle loom comprising a plurality of gripper shuttles presenting in cross section a plurality of obliquely inclined faces, shuttle picking means, shuttle catching means, shed-forming means, and means to return said shuttles from the catching to the picking side of the loom outside the shed, said return means comprising:

a. a rail extending across the loom between said picking and catching means, said rail having a groove in the upper surface thereof which is open upwardly and which is bounded at least in part by mutually inclined faces inclined to each other at substantially the same inclination as and engageable against the said faces of the shuttles;

b. an endless loop;

c. two wheels supported on opposite sides of the loom to carry said loop with one run thereof parallel to and adjacent said rail; and d. a plurality of carrier elements affixed to said loop, each of said elements having a portion extending laterally from the loop whereby upon passage of each such element along said run of the loop said element extends above said rail to a position above said groove to propel one of said shuttles therealong.

2. A loom according to claim 1 wherein said rail is made of elastic material.

3. A loom according to claim 1 wherein said rail is made of a synthetic resin.

4. A gripper shuttle loom comprising a plurality of gripper shuttles bounded in part by a plurality of mutually inclined faces, shuttle picking means, shuttle catching means, and means to return said shuttles from the catching to the picking side of the loom, said return means comprising:

a. a beam extending across the loom between said picking and catching means, said beam having a channel therein extending lengthwise thereof;

b. a rail disposed in said channel with clearance from one wall of the channel, said rail having a groove in the upper surface thereof which is open upwardly and which is bounded at least in part by opposite mutually inclined upwardly and outwardly extending faces inclined to each other at substantially the same inclination as the said faces of the shuttles;

c. an endless loop;

d. two wheels supported on opposite sides of the loom to carry said loop with one run thereof in said clearance; and e. a plurality of carrier elements affixed to said loop, each of said elements having a portion extending laterally from the loop whereby upon passage of each such element along said run of the loop said element extends to a position above said groove to propel one of said shuttles therealong.

5. A loom according to claim 4 wherein said rail is made of elastic material.

6. A loom according to claim 4 wherein said rail is made of a synthetic resin.

* * * * *